US006669280B1

(12) United States Patent
Wegner

(10) Patent No.: US 6,669,280 B1
(45) Date of Patent: Dec. 30, 2003

(54) FOLDING CHAIR

(76) Inventor: Christopher C. Wegner, 3764 N. 450 W., Winamac, IN (US) 46996

( * ) Notice: Subject to any disclaimer, the term of this patent is extended or adjusted under 35 U.S.C. 154(b) by 0 days.

(21) Appl. No.: 10/017,017

(22) Filed: Dec. 14, 2001

Related U.S. Application Data

(63) Continuation-in-part of application No. 09/625,704, filed on Jul. 25, 2000, now Pat. No. 6,394,541, which is a continuation of application No. 09/236,945, filed on Jan. 25, 1999, now Pat. No. 6,106,056.

(51) Int. Cl.[7] ..... A47C 4/00

(52) U.S. Cl. ..... 297/16.2; 297/16.1; 297/21; 297/22; 297/48; 297/452.13

(58) Field of Search ..... 297/16.1, 21, 22, 297/24, 25, 46, 48, 56, 59, 452.13, 452.2, 232, 248

(56) References Cited

U.S. PATENT DOCUMENTS 173,054 A 2/1876 Philips
220,949 A 10/1879 Wakefield (List continued on next page.)

FOREIGN PATENT DOCUMENTS

GB 24850 of 1907

OTHER PUBLICATIONS

Structured Products Company; The Amazing Packable Chair; Sep. 8, 1998 www.fastlane.net/~bobchair/welcome-.html.

Telescope Casual Furniture; Oct. 21, 1997 www.telescope-casual.com.

The Nantucket Beach Chair Company; Oct. 20, 1997 www.nantucketbeachchair.com.

Piedmont Tobacco Folding Chair; Oct. 20, 1997 www.the–forum.com/advert/piedmont.html.

Folding Oak Rockers; Oct. 20, 1997 www.webcom.com.

Portable Travel Chair; Oct. 17, 1997 www.wildfur.com.

Company B. Military Surplus Store; Oct. 11, 1997 www.i-inc.com.

*Primary Examiner*—Laurie K. Cranmer
(74) *Attorney, Agent, or Firm*—Woodard, Emhardt, Moriarty, McNett & Henry LLP

(57) ABSTRACT

A chair includes a first leg frame having first side rails with upper ends and a front cross rail connected to the upper ends; a second leg frame having second side rails; a back frame having back side rails with upper ends and a top cross rail connected to the upper ends of the back side rails; a frame link assembly having frame link members; a flexible support member extending between the top cross rail and the front cross rail; and, a central back link. One of the second side rails is pivotally connected along a first axis to one of the back side rails and is pivotally connected along a second axis to one of the first side rails, one of the frame link members is pivotally connected along a third pivot axis to one of the back side rails and is pivotally connected along a fourth pivot axis to one of the first side rails, and said central back link is pivotally connected along the first pivot axis to one of the second side rails and is pivotally connected along the third pivot axis to one of the frame link members.

38 Claims, 15 Drawing Sheets

U.S. PATENT DOCUMENTS

| | | | | |
|---|---|---|---|---|
| 233,732 | A | | 10/1880 | Cotton |
| 487,553 | A | | 12/1892 | Cole |
| 571,823 | A | | 11/1896 | Briggs |
| 780,006 | A | | 1/1905 | Mettler |
| 780,007 | A | | 1/1905 | Mettler |
| 780,009 | A | | 1/1905 | Mettler |
| 1,443,734 | A | | 1/1923 | Craig |
| 1,913,651 | A | | 6/1933 | Yamaoka |
| 1,949,282 | A | | 2/1934 | Murray |
| 1,969,313 | A | | 8/1934 | Meeker |
| 2,052,955 | A | | 9/1936 | Vanderminden |
| 2,074,998 | A | | 3/1937 | Kaufman |
| 2,704,569 | A | | 3/1955 | Salzer |
| 3,123,396 | A | | 3/1964 | Searle |
| 3,453,022 | A | | 7/1969 | Lecuyer |
| 4,008,918 | A | * | 2/1977 | Cooper et al. |
| 4,390,204 | A | | 6/1983 | Fleishman |
| 4,533,174 | A | | 8/1985 | Fleishman |
| 4,595,232 | A | | 6/1986 | Glenn et al. |
| 4,671,566 | A | | 6/1987 | Knapp et al. |
| 4,824,167 | A | | 4/1989 | King |
| 4,836,601 | A | | 6/1989 | Cone |
| 5,476,308 | A | | 12/1995 | St. Germain |
| 5,529,375 | A | * | 6/1996 | English |
| 6,170,907 | B1 | * | 1/2001 | Tsai |

* cited by examiner

FOLDING CHAIR

REFERENCE TO RELATED APPLICATIONS

This is a continuation-in-part of application, Ser. No. 09/625,704 filed on Jul. 25, 2000, now U.S. Pat. No. 6,394,541 which is a continuation of application, Ser. No. 09/236,945 filed on Jan. 25, 1999, now U.S. Pat. No. 6,106,056.

FIELD OF THE INVENTION

The present invention relates the field of furniture, and more particularly to folding and portable chairs and the like.

BACKGROUND OF THE INVENTION

Chairs constructed of hinged or similar construction enabling them to be folded and easily carried from one place to another, and enabling them to be conveniently stored, have long been known. Examples of portable and/or folding chairs are shown in the following U.S. Patents:

| U.S. Pat. No. | Inventor |
|---|---|
| 4,836,601 | Richard E. Cone |
| 4,824,167 | King |
| 4,671,566 | Knapp et al. |
| 4,595,232 | Glenn et al. |
| 4,533,174 | Fleishman |
| 4,390,204 | Fleishman |
| 3,453,022 | Lecuyer |
| 2,074,998 | Kaufman |
| 2,052,955 | Vanderminden |
| 1,969,313 | Meeker |
| 1,949,282 | Murray |
| 1,443,734 | Craig |
| 780,009 | Mettler |
| 780,007 | Mettler |
| 780,006 | Mettler |
| 487,553 | Cole |
| 233,732 | Cotton |
| 220,949 | Wakefield |
| 173,054 | Philips |

However, each of the chairs of the prior art suffers from one or more inherent disadvantage. For example, one of the most common portable, folding chairs is the type made of aluminum tubing sections that are pivotally interconnected to define a sturdy seat, back and arm/armrest combination that is easily foldable from a substantially flat storage condition to an erected sitting condition. The arm rests of such chairs are typically a structural necessity and are desired by most people for comfort. However, some find the arm rest structures constraining. For example, persons of large girth may find it particularly difficult or uncomfortable to sit in, and to get in and out of, such chairs where the chair arms define a relatively narrow passage. The chair arms of such portable, folding chairs may also present an undesirable obstruction for persons engaged in a particular activity while sitting, such as guitar playing, fishing, etc.

Such chairs also typically comprise a frame with a textile or synthetic material that, once torn or damaged, cannot easily be replaced or, if it were replaced, would not be cost effective to do so.

What is needed is an improved folding, portable and lightweight chair that permits unrestricted use by large and small persons alike and which offers as little obstruction as possible from activity while seated in the chair.

SUMMARY OF THE INVENTION

Generally speaking there is provided a portable chair that may be folded between a substantially flat storage and transport condition and an unfolded, erected condition which includes a seat and a back, but which does not include arms. The chair could be constructed to form a seat to accommodate one normal sized adult or could be constructed to form a bench to accommodate two or more normal sized adults.

In one embodiment, a chair includes a first leg frame having first side rails with upper ends and a front cross rail connected to the upper ends; a second leg frame having second side rails; a back frame having a plurality of back side rails with upper ends and mutually parallel axes, and a top cross rail connected to the upper ends of the back side rails; a frame link assembly having a plurality of frame link members with mutually parallel axes; a flexible support member extending between the top cross rail and the front cross rail; and, a central back link. One of the second side rails is pivotally connected along a first axis to one of the back side rails and is pivotally connected along a second axis to one of the first side rails, and one of the frame link members is pivotally connected along a third pivot axis to one of the back side rails and is pivotally connected along a fourth pivot axis to one of the first side rails, and said central back link is pivotally connected along the first pivot axis to one of the second side rails and is pivotally connected along the third pivot axis to one of the frame link members.

It is an object of the present invention to provide an improved folding, portable chair.

It is another object of the present invention to provide an improved folding, portable chair that has no arm members that maintains a high degree of strength and stability.

Other objects and advantages of the present invention will become apparent from the following description of the preferred embodiment.

DESCRIPTION OF THE PREFERRED EMBODIMENT

Figure 1:
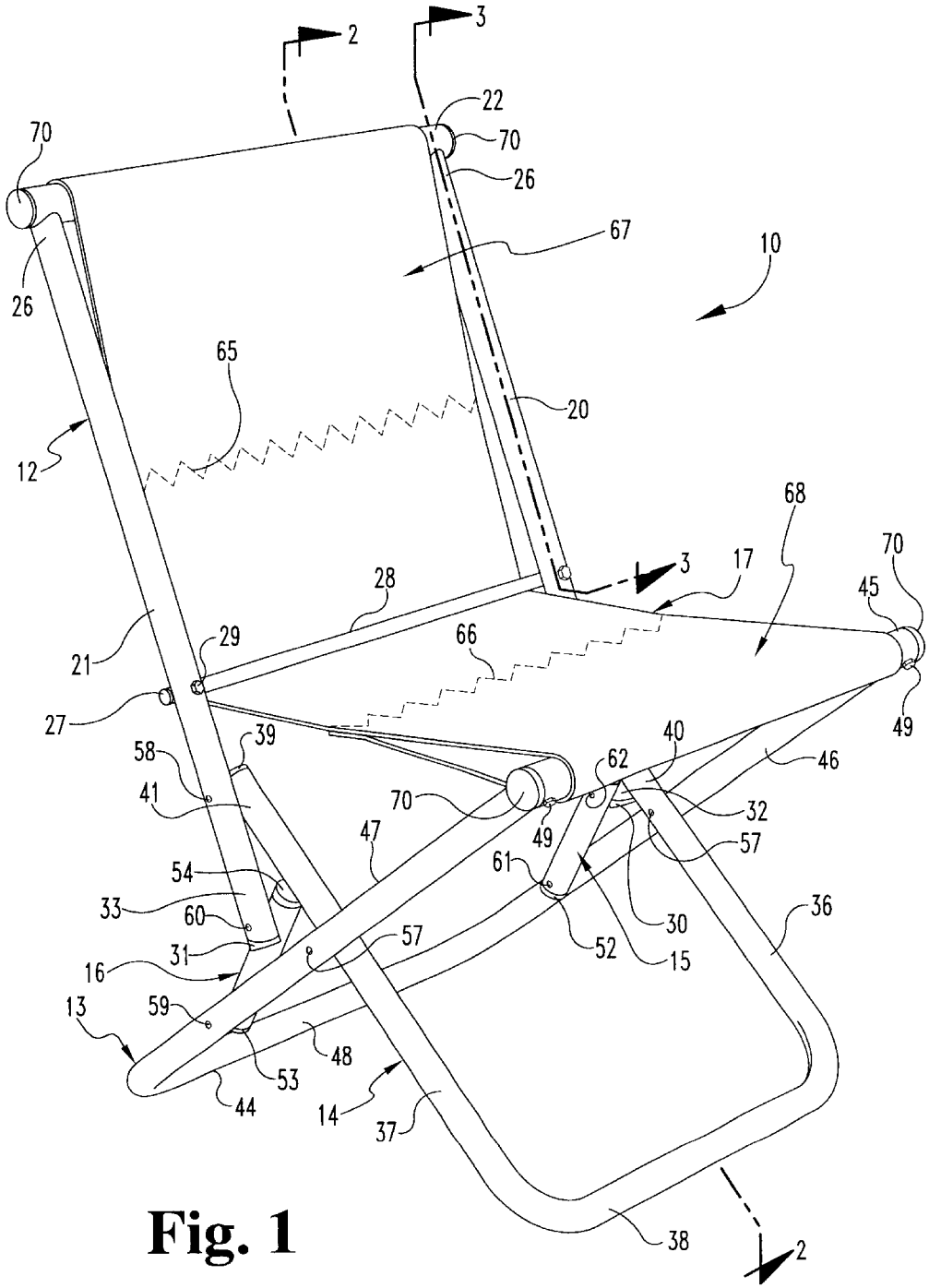
FIG. 1 is a perspective view of the folding chair 10 in accordance with one embodiment of the present invention, and shown in the erected, rest position.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 2:
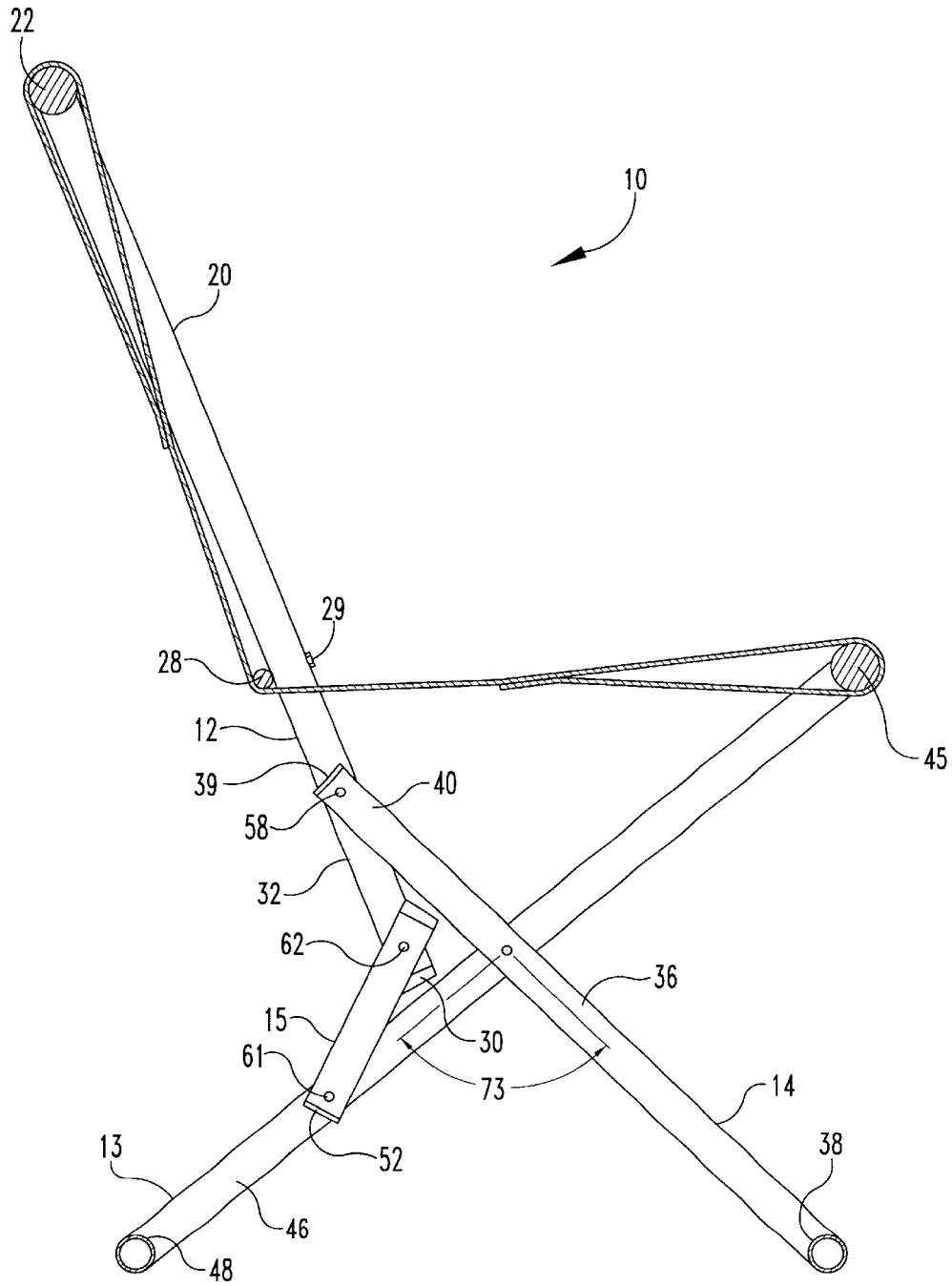
FIG. 2 is a side cross sectional view of the folding chair 10 of FIG. 1, taken along the lines 2—2 and viewed in the direction of the arrows.
Figure 3:
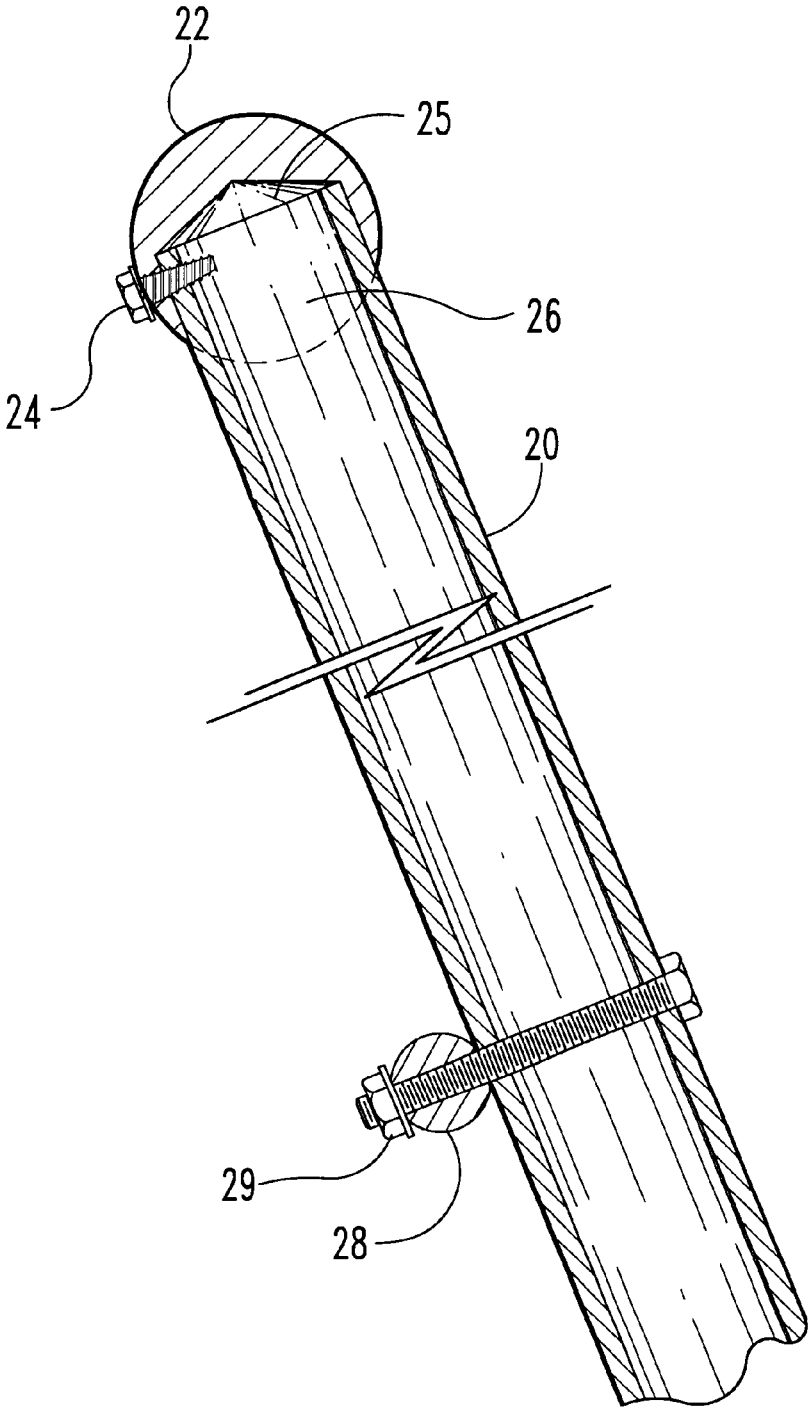
FIG. 3 is a side cross sectional view of a portion of the folding chair 10 of FIG. 1, taken along the lines 3—3 and viewed in the direction of the arrows.

Referring now to FIGS. 1–3, there is shown a folding chair 10 in accordance with one embodiment of the present invention. Chair 10 generally includes back frame 12, first leg frame 13, second leg frame 14, left frame link 15, right frame link 16, and flexible support 17. Frames 12, 13, and 14 and links 15 and 16 are each made of a material which provides an optimal balance among strength, weight, and cost. It is believed that aluminum tubing achieves this optimal balance, but other materials and shapes are also contemplated.

Back frame 12 has a generally U-shaped configuration consisting of left and right hollow tubing side rails 20 and 21, respectively, and a top cross rail 22. In one embodiment top cross rail 22 is solid, has a round cross section, and defines a pair of recesses 25 at each end (one shown in FIG. 3) that are shaped and sized to receive the complimentary-shaped upper rail portions 26 of the corresponding side rails 20 and 21. A screw 24 extends through aligned holes in top cross rail 22 and the corresponding side rails 20 and 21 to firmly lock cross rail 22 to each side rail 20 and 21. In the alternative, cross rail 22 may be of hollow tubing or may be of other suitable shape and size as is well known in the art. Cross rail 22 may also be secured to the front or back sides of side rails 20 and 21 by appropriate fasteners. Alternatively, side rails 20 and 21 may be of a particular shape to receive and be secured to a complementary-shaped cross rail 22.

A cross bar 28 spans left and right side rails 20 and 21 and is fastened to the back side of and slightly more than half way down along rails 20 and 21 and is secured thereto by appropriate fasteners such as a bolt, lockwasher, and nut combination 29. Protective end caps 27 are provided at the opposing outer ends of cross bar 28. End caps 30 and 31 are provided at the ends of lower rail portions 32 and 33 of side rails 20 and 21, respectively. End caps 30 and 31 are made of any appropriate material which provides some cushioning to the contact between rails 20 and 21 and first leg frame 13. It is preferred that end caps 30 and 31 be comprised of an appropriate rubber or plastic.

Second leg frame 14 is tubular with a U-shaped configuration having left and right side rails 36 and 37, respectively, and bottom cross rail 38 extending therebetween. Protective end caps are provided at the ends of upper portions 40 and 41 of side rails 36 and 37.

First leg frame 13 has a generally rectangular box-shaped configuration and comprises a U-shaped tubular frame 44 and a front cross rail 45. U-shaped tubular frame 44 is similar to second leg frame 14 and has left and right side rails 46 and 47, respectively, and bottom cross rail 48 extending therebetween. Front cross rail 45 is substantially identical to top cross rail 22 and is rigidly connected to the upper ends of side rails 46 and 47 by screws 49 in a manner that is substantially identical to the way top cross rail 22 is secured to left and right side rails 20 and 21. As with top cross rail 22, front cross rail 45 may be of alternative shape and configuration so long as it creates, along with left and right side rails 46 and 47, a strong and stable frame for tautly supporting flexible support 17.

Left and right frame links 15 and 16 are also tubular and are provided with lower protective end caps 52 and 53 and upper end caps 54 and 55, respectively. Upper end caps 54 and 55 are like end caps 30 and 32, preferably made of an appropriate rubber or plastic to provide some cushioning to the contact between frame links 15 and 16 and second leg frame 14.

As shown in FIGS. 1 and 2, side rails 36 and 37 of second leg frame 14 are coaxially rotatably connected at their approximate mid points by pivot pins 57 to the inside of and at the approximate mid points of side rails 46 and 47 of first leg frame 13. Left and right side rails 36 and 37 are further pivotally connected by coaxial pivot pins 58 at their upper rail portions 40 and 41 to the inside of and a short distance above the lower ends of left and right side rails 20 and 21 of back frame 12.

Further, as shown in FIGS. 1 and 2, left frame link 15 is pivotally connected at its lower end by pivot pin 61 to the inside of left side rail 46 approximately mid way between pivot pin 57 and bottom cross rail 48. Left frame link 15 is pivotally connected at its upper end by a pivot pin 62 to the inside of and at the lower end of left side rail 20. Likewise, right frame link 16 is pivotally connected at its lower end by pivot pin 59 to the inside of right side rail 47 approximately mid way between pivot pin 57 and bottom cross rail 48, and is pivotally connected at its upper end by a pivot pin 60 to the inside of and at the lower end of right side rail 21.

Pivot pins 57–62 may be comprised of any suitable device which holds one element together for rotation relative to another element. For example, pivot pins 57–62 may comprise screw and nut combinations or rivets. Pivot pins 57 are coaxial; pivot pins 58 are coaxial; pivot pins 59 and 61 are coaxial and pivot pins 60 and 62 are coaxial.

Flexible support 17 is comprised of any appropriate flexible material that will be strong enough to support a person sitting thereon. For example, the material may be a textile or a synthetic material. The material forming support 17 is essentially a band, each end of which is looped around and stitched back upon itself at 65 and 66 to form back loop 67 and seat loop 68.

Figure 4:
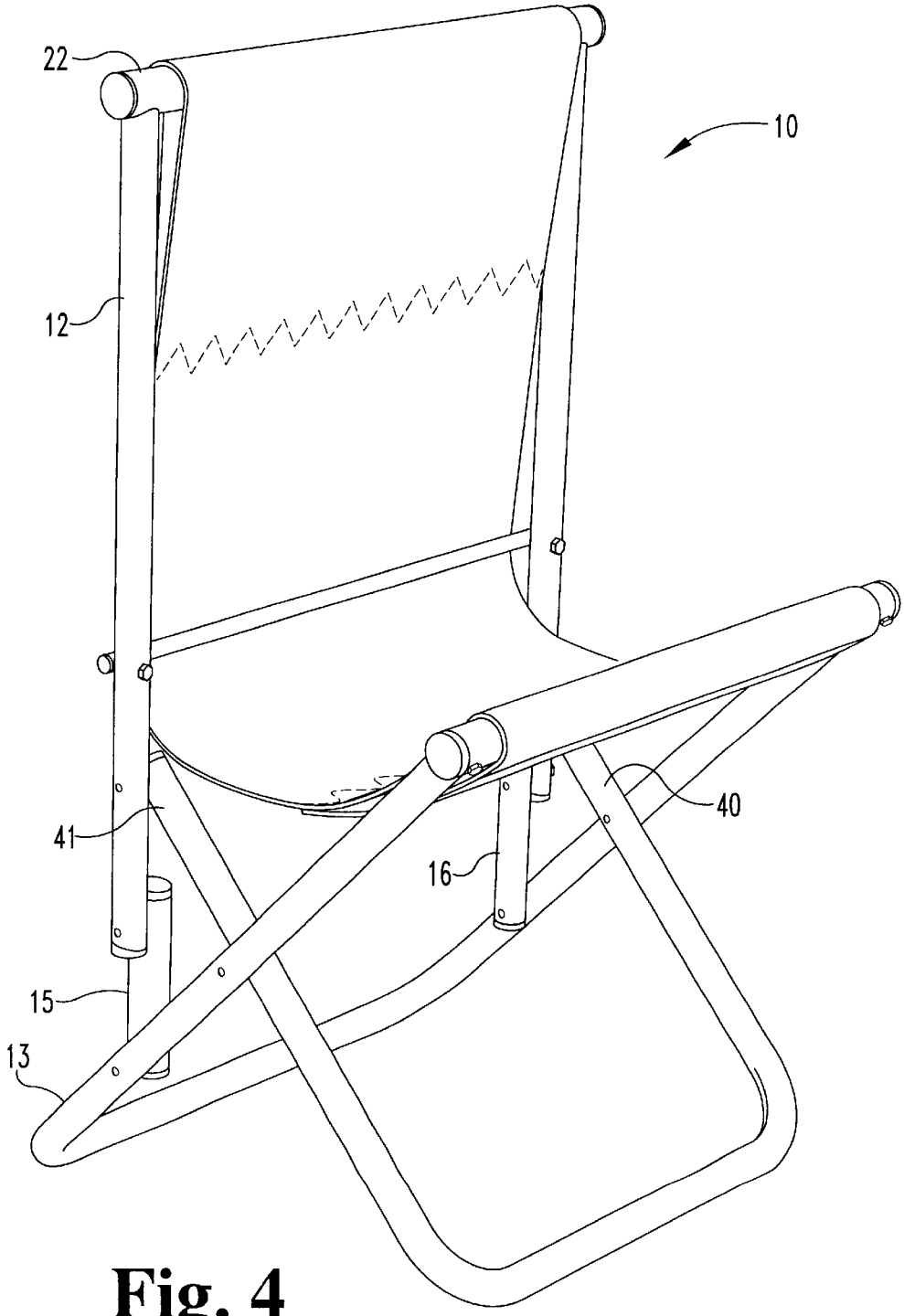
FIG. 4 is a perspective view of the folding chair 10 of FIG. 1 and shown in the mid-fold condition.

In assembly, screws 24 are removed and top cross rail 22 is separated from side rails 20 and 21. Top cross rail 22 is slid through back loop 67, and top cross rail 22 is then reconnected to side rails 20 and 21 and secured thereto with screws 24. Support 17 is passed below cross bar 28, and is similarly connected to first leg frame 13 by passing detached front cross rail 45 through seat loop 68 and then resecuring front cross rail 45 back to first leg frame 13 with screws 49. Flexible support 17 is applied to back frame 12 and leg frame 13 typically with chair 10 in the mid-fold condition shown in FIG. 4 so that there will be ample play in flexible support 17.

Top cross rail 22 and front cross rail 45 are also provided with end caps 70. End caps 27, 39, 52, 53, and 70 may be made of any material which appropriately closes off and protects the ends of the corresponding tubular or solid member. Alternative embodiments are contemplated where the tubular members would be closed off and protected from damage and protect the user from injury by means other than application of an end cap. For example, the ends could be formed in a rounded, closed-off condition, free of sharp edges. End caps 30, 31, 54, and 55 should be comprised of a material which at a minimum reduces the possibility of damage due to repeated contact between frame links 15 and 16 and leg frame 14 and between back frame 12 and first leg frame 13, when those components come in contact with each other as described herein. It is preferable that end caps 30, 31, 54, and 55 have some degree of resilience to further cushion the impact between the corresponding components. Such end caps may be comprised of a plastic or rubber material. All of the aforedescribed end caps are connected to their respective components by any appropriate means such as by screws or pressure fitting or adhesive. End caps 27, 39, 52, 53, and 70 do not need to have the same cushioning characteristics that are desired for end caps 30, 31, 54, and 55.

In use, chair 10 has an erected, rest condition as shown in FIGS. 1 and 2 whereby the angle 73 formed between first leg frame 13 and second leg frame 14 is just less than its maximum erected angle, and end caps 30 and 31 are not in contact with their corresponding leg frame 13 and end caps 54 and 55 are not in contact with their corresponding leg frame 14. In one embodiment, angle 73 in the erected, rest position is approximately 98 degrees. When a person of sufficient weight sits in chair 10 (FIG. 5), chair 10 folds to its erected, stressed condition whereby frame members 13 and 14 spread apart a few degrees further, angle 73 thereby increases to approximately 104 degrees, and end caps 30 and 31 and 54 and 55 come into contact with their corresponding and respective leg frames 13 and 14, as shown. (As used herein, "folds" or "folding" refers to the synergistic pivoting of the frames and links of chair 10 among the fully folded condition (FIG. 6), the erected, rest condition (FIG. 1) and the erected, stressed condition (FIG. 5)). Chair 10 is limited from pivoting beyond the erected, stressed condition shown in FIG. 5 by the engagement of frame links 15 and 16 against the underside of second leg frame 14 and the engagement of the lower ends of side rails 20 and 21 against side rails 46 and 47, respectively. The particular dimensions of the frames and links of chair 10 are chosen in connection with the length of flexible support 17 from loop 67 to loop 68, and in connection with the location of cross bar 28 secured to back frame 12, so that flexible support 17 will be very taut from top cross rail 22, passing below cross bar 28, and to front cross rail 45 when chair 10 is in the erected, stressed condition. Thus, when the person rises from seat 10, the tension of flexible support 17 pulls seat 10 back from the erected, stressed condition (FIG. 5) to the erected, rest condition (FIG. 1). Seat 10 may then be folded from the erected, rest condition (FIG. 1) by pulling front cross rail 45 towards top cross rail 22, whereby the components of chair 10 pivot relative to each other through the mid-fold condition (FIG. 4) and ultimately to the collapsed condition as shown in FIG. 6. In the collapsed condition (FIG. 6), the components (frames 12–14 and links 15 and 16) have assumed a stacked configuration that is only slightly taller than the tallest component (e.g. back frame 12 or second leg frame 14) and is very narrow, as well. This makes chair 10 convenient to store and transport.

The present invention contemplates that the angle 73 formed between first and second leg frames 13 and 14 about pivot pins 57 preferably in the erected, rest condition (FIG. 1) be about 98 degrees and in the collapsed condition (FIG. 6) be about 10 degrees. However, these angles 73 may vary with the particular dimensions of the various components of chair 10 and with the particular pivotal connection locations of the various components of chair 10.

Alternate embodiments are contemplated wherein second leg frame 14 and frame links 15 and 16 are pivotally secured to the outside of, instead of to the inside of, back frame 12 and first leg frame 13.

Figure 8:
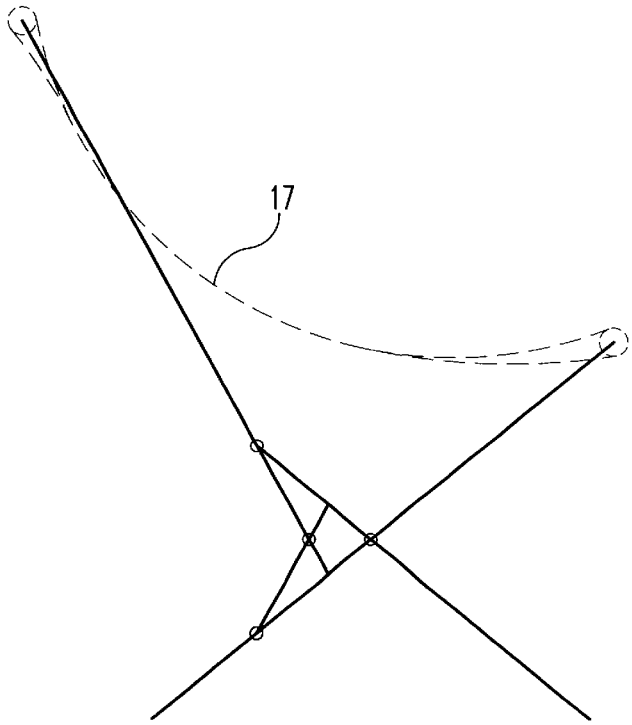
FIG. 8 is a side elevational view of an alternative embodiment of the present invention.
Figure 7:
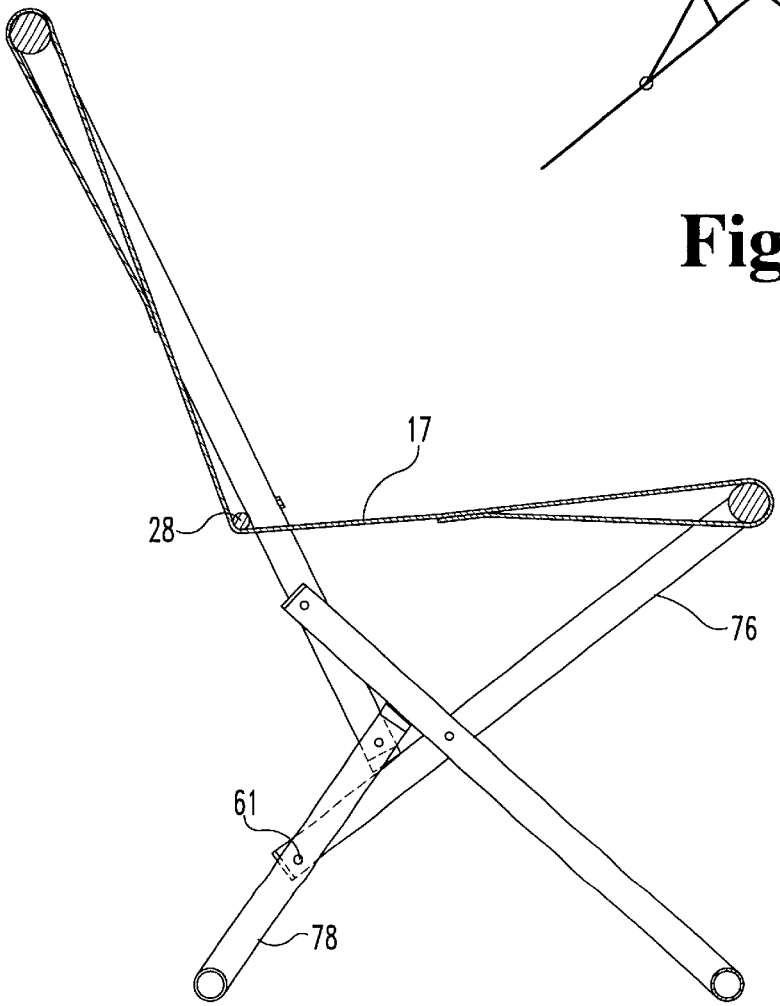
FIG. 7 is a side elevational view of an alternative embodiment of the present invention.

FIGS. 7–10 show alternative embodiments contemplated by the present invention. Referring to FIGS. 2 and 7, first leg frame 13 is essentially shortened with its lower portion removed up to pivot pin 61 to form a generally U-shaped member 76, and left and right frame links 15 and 16 are extended down to the ground and into a U-shaped member 78. FIG. 8 shows diagrammatically the embodiment of FIG. 2 but with flexible support 17 shown in a sling configuration without the use of horizontal crossbar 28.

Figure 9:
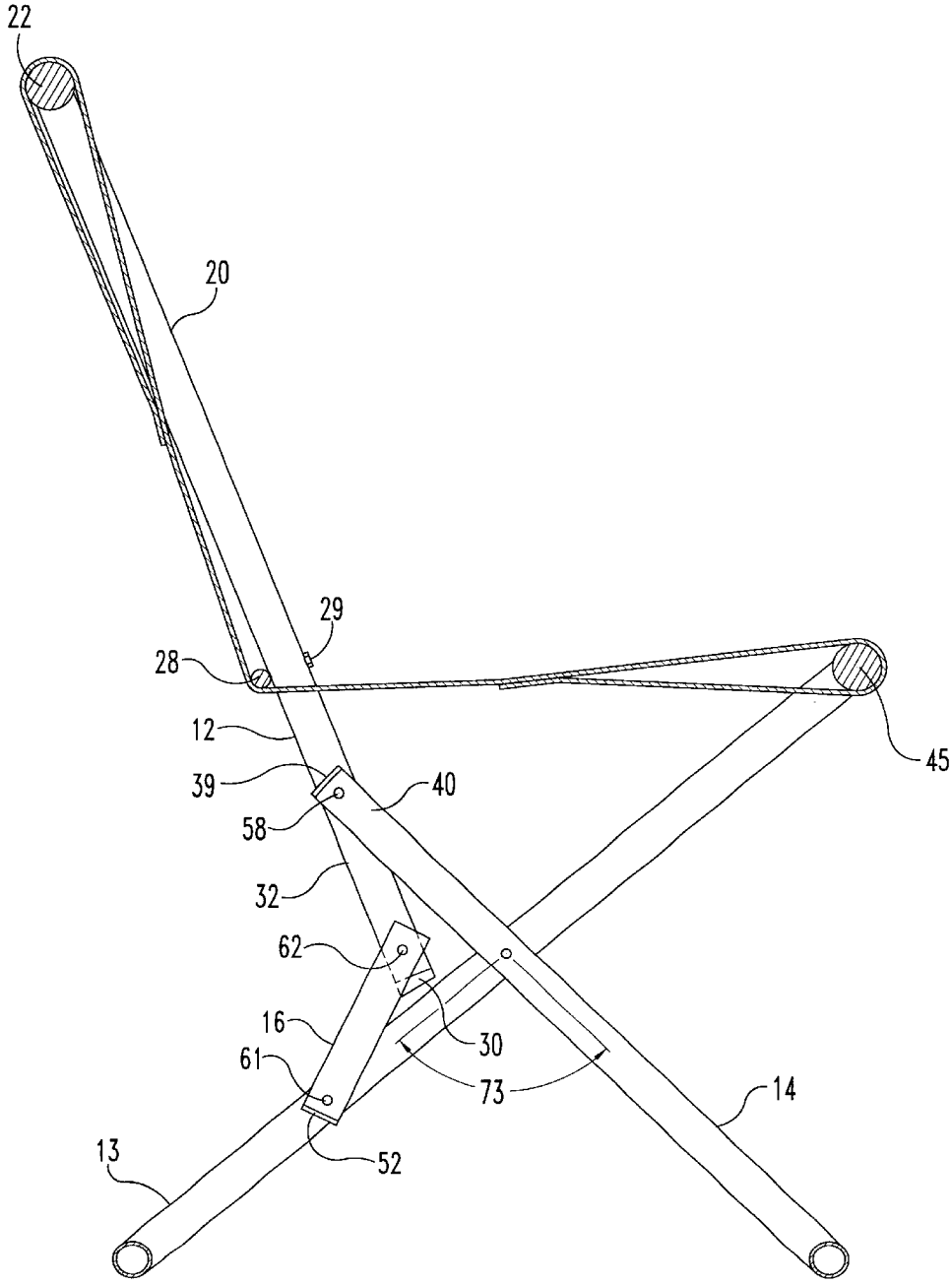
FIG. 9 is a side elevational view of an alternative embodiment of the present invention.
Figure 10:
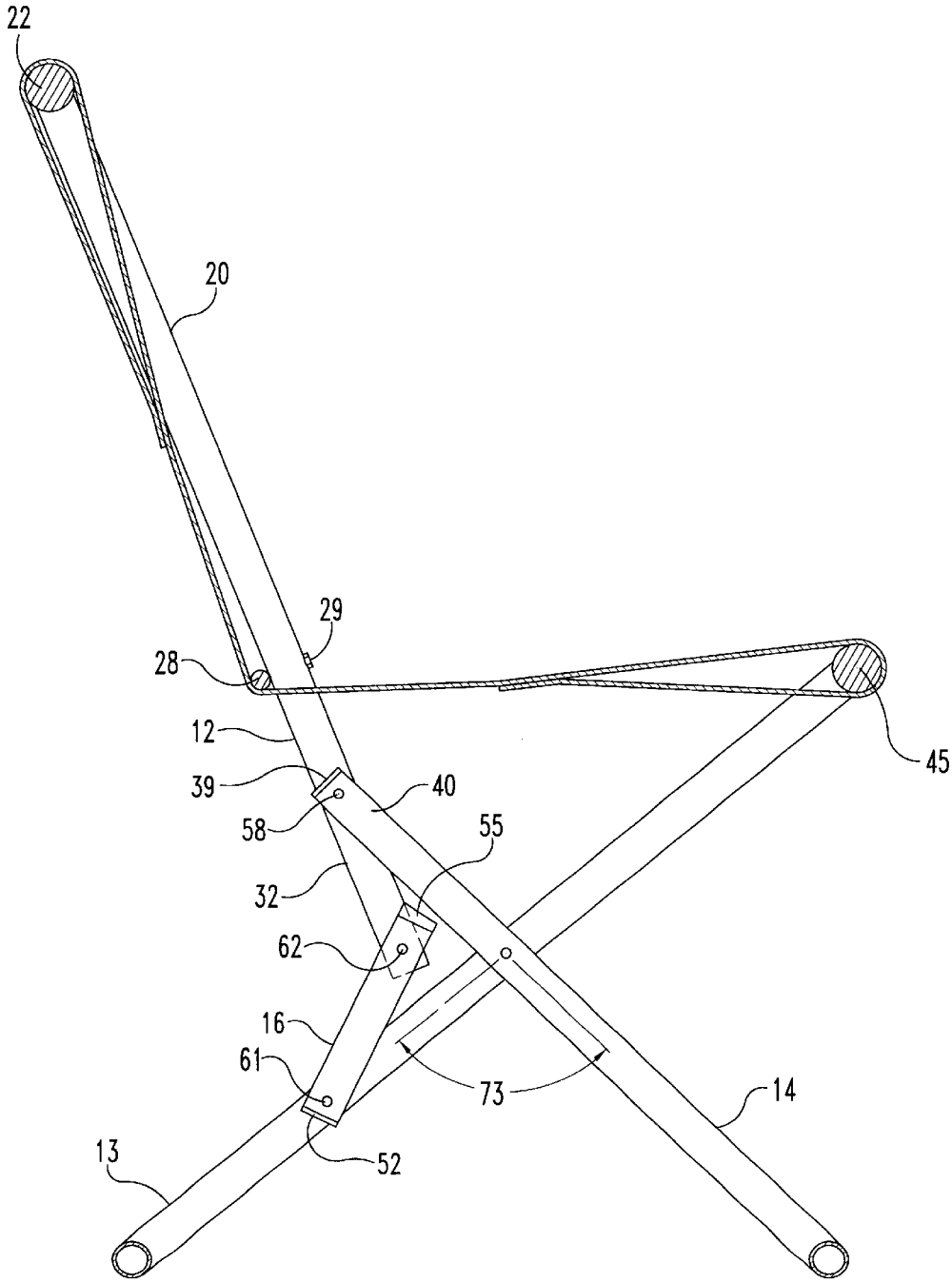
FIG. 10 is a side elevational view of an alternative embodiment of the present invention.

FIGS. 9 and 10 show alternative embodiments where only one pair of stop members is used to define the opening limits of chair 10. That is, referring to FIG. 9, only back frame 12 is extended far enough below pivot pins 60 and 62 to engage with first leg frame 13 to define the opening limit of chair 10 at the erected, stressed condition. The upper portion of left and right frame links 15 and 16 are shortened and do not engage with second leg frame 14. Likewise in FIG. 10, only left and right frame links 15 and 16 engage with second leg frame 14 to define the opening limit of chair 10 and the lower portions of back frame 12 are shortened and do not engage with first leg frame 13.

Back frame 12 has been described as a three piece unit. Alternative embodiments are contemplated wherein back frame 12 is a single-piece, U-shaped frame, similar to second leg frame 14, or is yet another configuration or construction that is pivotally connected, as described herein, to leg frame 14 and frame links 15 and 16. In such case, flexible support 17 may be made the same, which would make removal/repair thereof difficult; or flexible support 17 may be made in an alternative configuration, facilitating its removal from back frame 12 without disassembling any of the frame elements of chair 10. For example, but in no way limiting, support 17 may be connected with either or both top and front cross rails 22 and 45, respectively, by appropriate connectors such as snaps, wires, chains, ropes, or any other device that sufficiently securely connects support 17 to cross rails 22 and 45 and permits its ready detachment, as desired. Likewise, the present invention contemplates leg frames 13 and 14 being of alternative constructions comprising one, two, three or more components.

It is further contemplated that frame links 15 and 16 could comprise a single frame link having a U-shaped, box-shaped, or other appropriate configuration, but still pivotally connecting the left and right side rails of the second leg frame with the corresponding left and right side rails of the lower back frame, as described herein.

Figure 5:
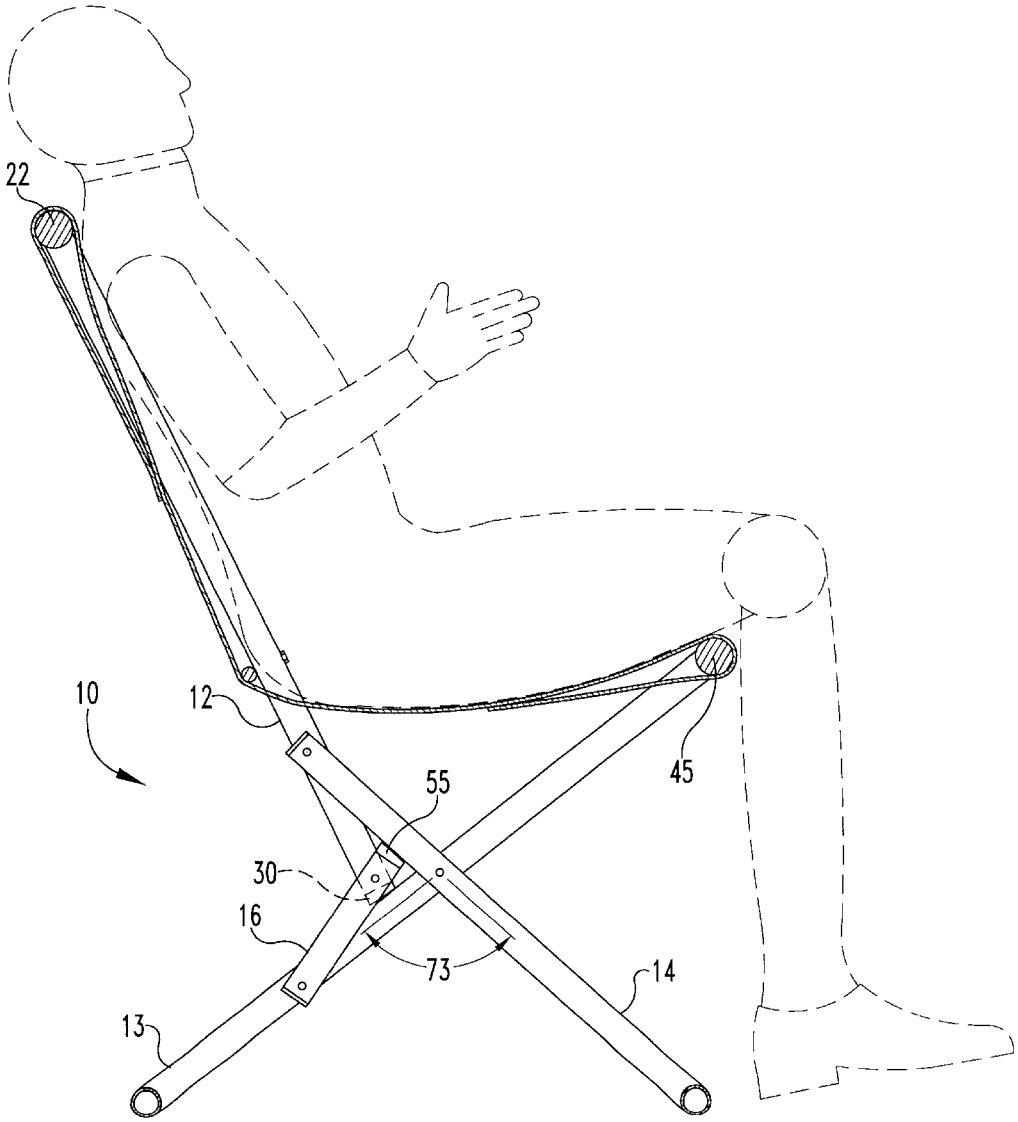
FIG. 5 is a side cross sectional view of the chair 10 of FIG. 2 shown stressed to the erected, stressed condition as a result of a person sitting therein.
Figure 6:
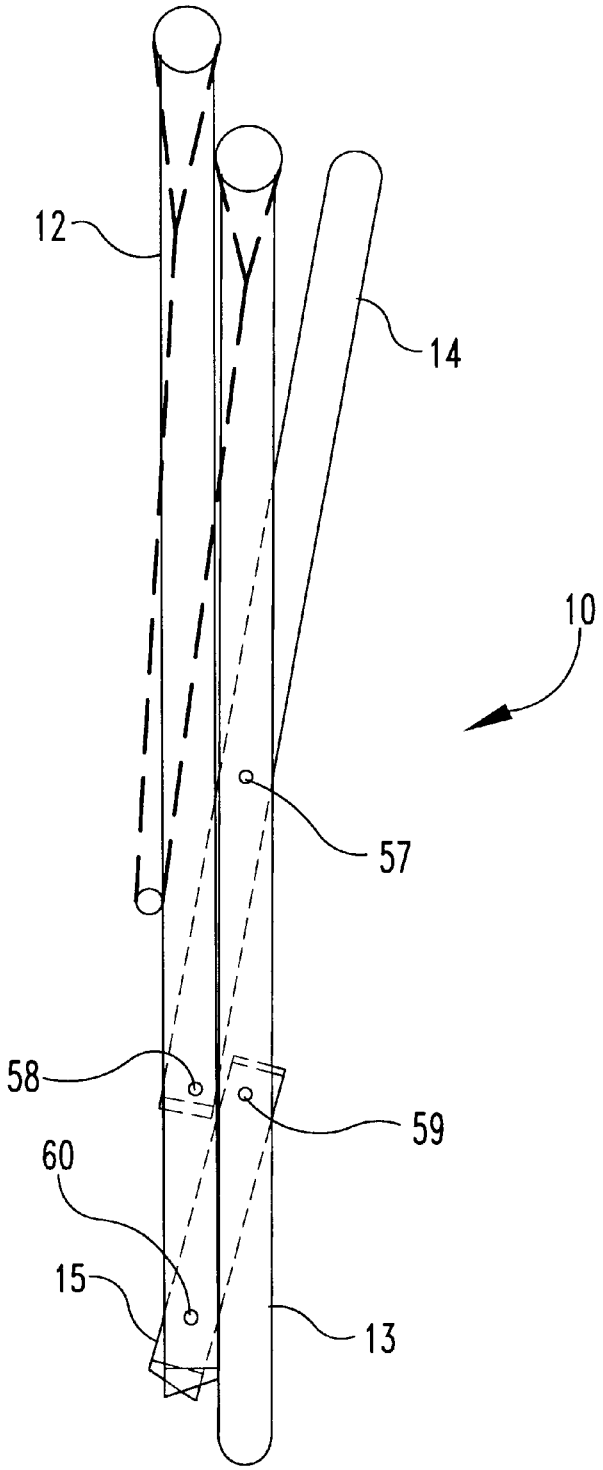
FIG. 6 is a side elevational view of the folding chair 10 of FIG. 1 and shown in the collapsed condition.

The present invention further contemplates a construction of chair 10 where chair 10 is folded directly to a fully erected condition wherein end caps 30 and 31 and 54 and 55 are engaged with their corresponding and respective leg frame 13 and 14, as shown in FIG. 5. That is, the fully erected condition is achieved without the need for a person to sit in chair 10, but simply by folding chair 10 thereto.

Figure 11:
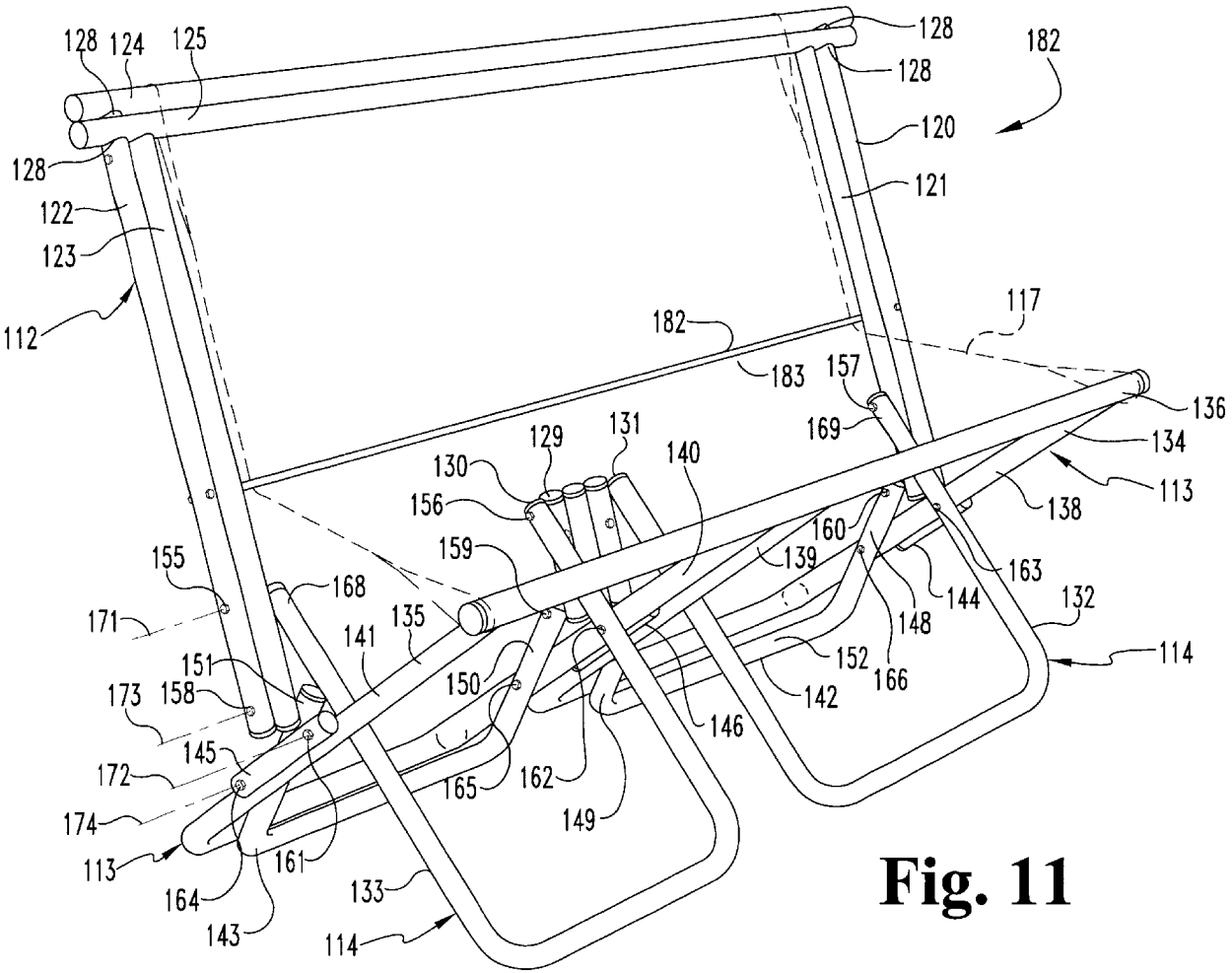
FIG. 11 is a perspective view of a folding chair 110 in accordance with another embodiment of the present invention, and shown in the erected, rest position.

Referring to FIG. 11, there is shown a folding chair 110 in accordance with an alternative embodiment of the present invention. Chair 110 is similar to the chair 10 of FIG. 1 except that chair 110 is larger and intended to accommodate two or more people. Where chair 10 includes back frame 12, first leg frame 13, second leg frame 14, left frame link 15, right frame link 16, and flexible support 17, chair 110 includes back frame 112, first leg frame 113, second leg frame 114, frame links 115, and flexible support 117. Back frame 112 includes a pair of left side rails 120 and 121, a pair of right side rails 122 and 123 and a pair of top cross rails 124 and 125. Rails 120–125 are all arranged in a common plane and in abutting side-by-side pairs, as shown. The outer rails 120 and 122 extend up through holes (at 128) in top cross rails 124 and 125, while the tops of the inner rails 121 and 123 butt up against the underside of lower top cross rail 125. Back frame 112 further includes a central back link comprising three spacer links 129 that lie in the same plane with rails 120–125. The pair of side rails 120 and 121 (and likewise the pair of rails 122 and 123 and/or the pair of rails 124 and 125 and/or the three links 129) could comprise a single member made in a shape and of a material to exhibit sufficient strength to tolerate the loads subjected to chair 110. Alternatively, side rails 120–123 and top rails 124 and 125 are contemplated to comprise one or more pieces, assembled and appropriately connected together, to make the back frame 112 substantially as shown, ready to receive flexible support 117 and strong enough to tolerate the loads subjected to chair 110.

Second leg frame 114 comprises two, U-shaped leg frames 132 and 133, each substantially identical to the single leg frame 14 of chair 10. It is contemplated that second leg frame 114 could comprise a one-piece leg frame instead of the two frames 132 and 133. For example, the upper ends 130 and 131 of the inner rails of leg frames 132 and 133 may be rigidly, and perhaps integrally joined, either above spacer links 129 or as a part of their connection to spacer links 129.

First leg frame 113 is similar to first leg frame 13, except that it comprises two U-shaped tubular leg frames 134 and 135. The top ends of the four side rails 138–139 and 140–141 of frames 134 and 135, respectively, are rigidly, but removably connected to a front cross rail 136. As with chair 10, top cross rails 124 and 135 and front cross rail 136 are detachable from their respective side rails to facilitate the [application] assembly, repair and maintenance of flexible support 17. First leg frame 113 further includes left and right outer stop members 144 and 145 and leg spacer member 146. Outer stop members 144 and 145 are rigidly connected to the outsides of outer rails 138 and 141, respectively, and are positioned to provide, along with outer rails 138 and 141, stop surfaces for the bottom ends of side rails 120–123. Leg spacer member 146 is fixedly connected between and against the center side rails 139 and 140, as shown in FIG. 11.

As with chair 10 of FIG. 1 where there are two frame links 15 and 16 connected to the opposing side rails of the first and second leg frames 13 and 14, chair 110 includes frame links 115 that are connected in a substantially similar manner to the side rails of the first and second leg frames 113 and 114. In the embodiment of FIG. 11, there are two such frame links 142 and 143 that differ from the frame links 15 and 16 of chair 10 by the addition of a cross member at their bottom ends. Thus, frame link 142 is U-shaped having opposing left and right frame link members 148 and 149 (for pivotal connection with side rails 138 and 139), and link 143 is U-shaped having opposing left and right frame link members having 150 and 151 (for pivotal connection with side rails 140 and 141). Frame link members 148 and 149 are joined at their bottom ends by a frame link cross member 152, and frame link members 150 and 151 are joined at their bottom ends by a frame link cross member and 153. Alternatively, and for additional stability, the two frame links 142 and 143 are contemplated to be connected to each other by a common bottom cross member, configured to rigidly join all four of the frame link members 148–151 together without interfering with the folding and unfolding action and limits of chair 110.

The back frame 112, first leg frame 113, second leg frame 114 and frame links 115 are operatively interconnected by various pivot pins (155–166, for example) in a manner substantially the same as the back frame 12, first leg frame 13, second leg frame 14 and frame links 15 of chair 10. Pins connecting like pivot points are coaxially aligned. For example, in coaxial alignment along a first pivot axis 171 are pin 155 (pivotally connecting right side rails 122 and 123 with the top end 168 of the right rail of leg frame 133), pin 156 (pivotally connecting the top end 130 of right leg frame 133 with the top end 131 of left leg frame 132 and with the top ends of spacer links 129 therebetween), and pin 157 (pivotally connecting left side rails 120 and 121 with the top end 169 of the left rail of leg frame 132). And in coaxial alignment along a third pivot axis 173 are pin 158 (connecting the lower ends of rails 122 and 123 with frame link 151), pin 159 (connecting frame link 150 with frame link 149 and with the lower ends of spacer links 129), and pin 160 (connecting frame link 148 with left side rails 120 and 121).

In alignment along a second pivot axis 172 are pin 161 (connecting outer stop member 145 to side rail 141 and pivotally to the right rail of leg frame 133), pin 162 (connecting the left rail of leg frame 133 with rails 140 and 139 and leg spacer member 146, and with the right side rail of leg frame 132), and pin 163 (connecting the left rail of leg frame 132 with rail 138 and outer stop member 144).

In alignment along a fourth pivot axis 174 are pin 164 (connecting outer stop member 145 to side rail 141 and pivotally to right frame link 151), pin 165 (connecting left frame link 150 with rails 140 and 139 and leg spacer member 146, and with right frame link 149), and pin 166 (connecting left frame link 148 with rail 138 and outer stop member 144).

The upper ends of center side rails 139 and 140 are received within complementary shaped holes (not shown) in cross rail 136 and secured thereat by appropriate means such as screws, adhesive or pressure fit. Flexible support 117 is provided with openings (not shown) at the juncture of rails 139 and 140 with cross rail 136, and chair is there assembled by first positioning support 117 appropriately so that the openings in support 117 are aligned with the holes in cross rail 136, and then by inserting the ends of rails 139 and 140 through the holes in flexible support 117 and into the holes in cross rail 136.

In operation and use, chair 110 works substantially the same as chair 10 and has substantially the same profile as chair 10 in FIG. 6. One notable exception is that the frame links 148–151 and cross members 152 and 153 extend upwardly a short distance more than the frame links 15 and 16.

Figure 13:
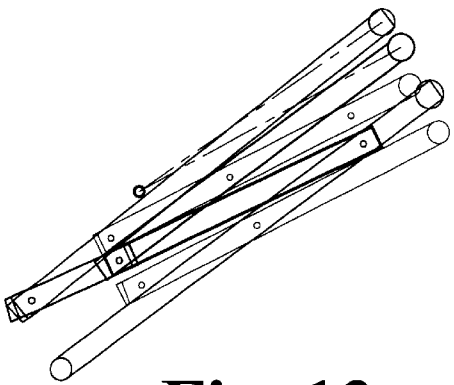
FIG. 13 is a side elevational view of the chair of FIG. 12 and shown in the collapsed condition.
Figure 12:
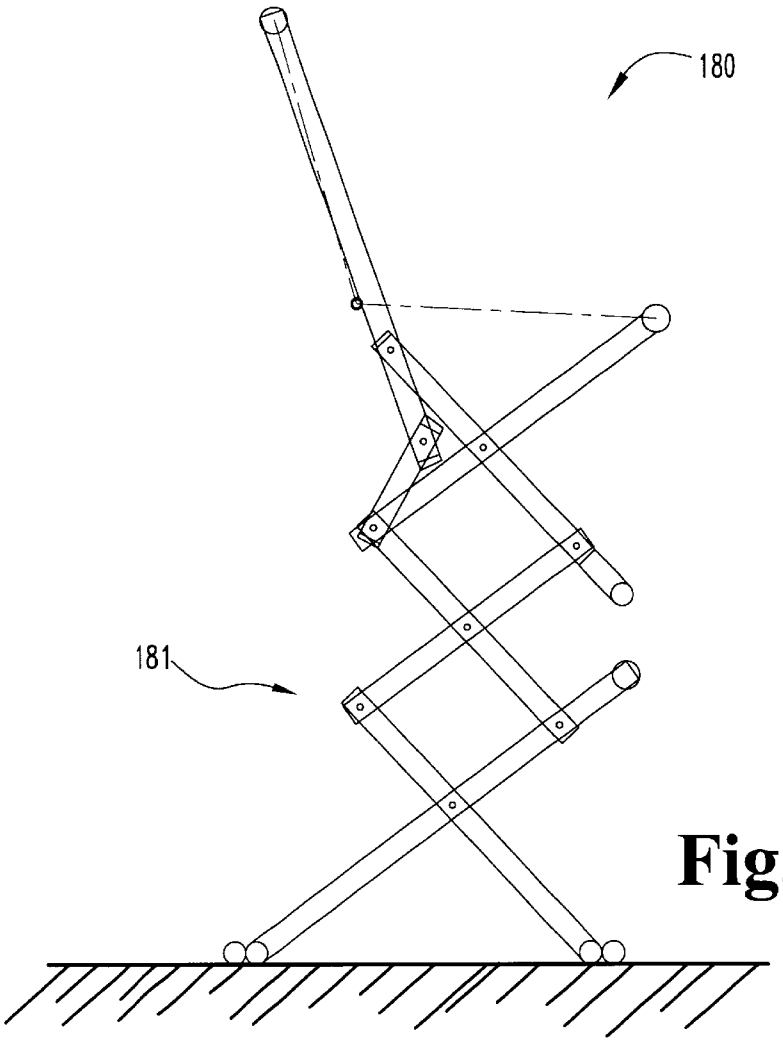
FIG. 12 is a side elevational view of an alternative embodiment of the present invention and shown in the erected, rest position.

Referring to FIGS. 12 and 13, there is shown a folding chair 180 in accordance with an alternative embodiment of the present invention. Chair 180 is similar to the chair 10 of FIG. 1 and, in addition, adds multiple articulating links 181 to provide a higher sitting height, as in a director's chair. Chair 180 has the very flat folded configuration shown in FIG. 13.

Leg frames 113 and 114 and frame links 115 all include U-shaped frames; however, other embodiments contemplate alternative configurations. For example, instead of cross member 153 extending between the opposing frame link members 150 and 151, cross member 153 could be located midway up to form an H-shaped frame link, or it could comprise two cross members to form an X-shaped member between frame link members 150 and 151.

Figure 14:
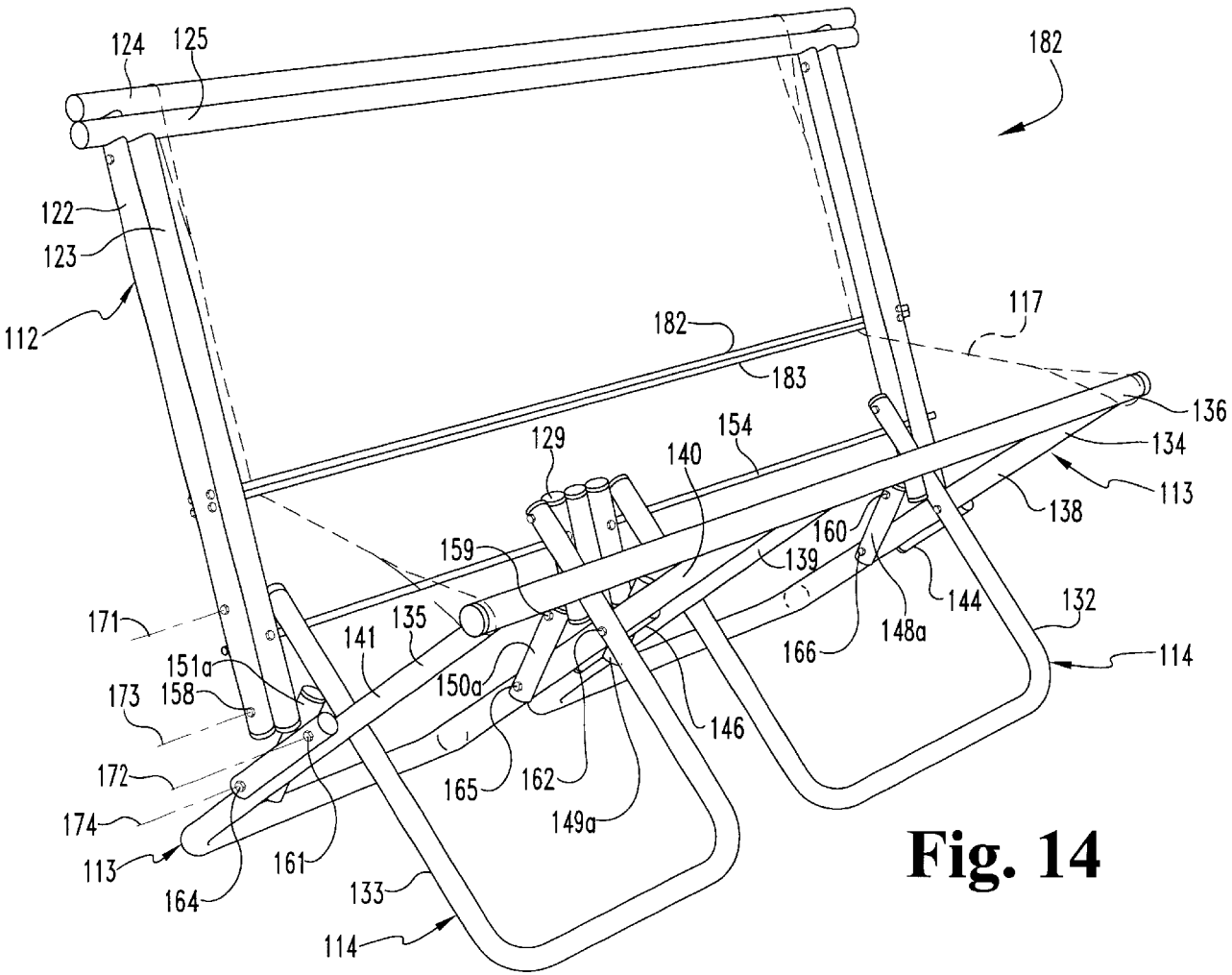
FIG. 14 is a perspective view of a folding chair 182 in accordance with an alternative embodiment of the present invention, and shown in the erected, rest position.

In an alternative embodiment shown in FIG. 14, chair 182 is substantially the same as chair 110 of FIG. 11, except that instead of the U-shaped frame links 142 and 143, frame links are provided that are similar to the frame links 15 and 16 of the chair of FIG. 1 and comprise a total of four, short frame links 148*a*, 149*a*, 150*a* and 151*a* with no interconnecting frame link cross members 152 and 153. The short frame links 148*a*–151*a* are operatively pivotally connected by the same pivot pins 158–160 and 164–166 to back frame 112 and first and second leg frames 113 and 114. Additional structural stability is provided by a lower cross bar 154 that extends across the backside of and is secured to back frame 112 and spacer links 129, as shown. Further stability may be afforded by using larger dimensional members, or members having different shapes and compositions, or by adding additional members. For example, one embodiment includes using two cross bars 183 and 184, one above the other, on the back side of back frame 112 and under which extends flexible support 117.

Figure 15:
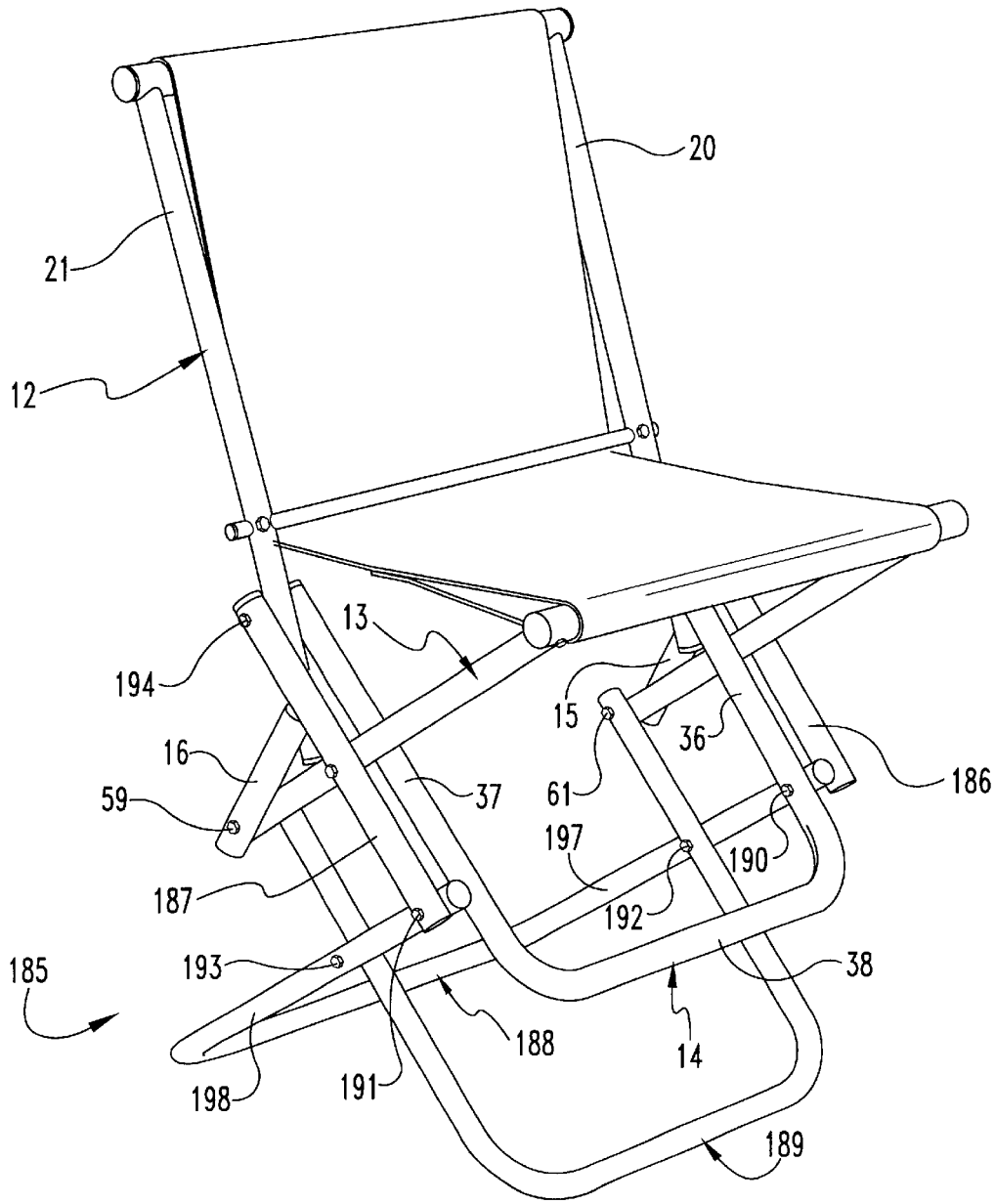
FIG. 15 is a perspective view of a folding chair 185 in accordance with an alternative embodiment of the present invention, and shown in the erected, rest position.

Referring to FIG. 15, there is shown a folding chair 185 in accordance with another embodiment of the present invention. Chair 185 is similar to the chair 10 of FIG. 1 and in addition, includes outer support links 186 and 187 and third and fourth leg frames 188 and 189, respectively. Left and right frame links 15 and 16 are pivotally connected to back frame 12 and first leg frame 13. Fourth leg frame 189 is U-shaped and pivotally connected to the lower end of first leg frame 13 at the pivot pins 59 and 61 that connect frame links 15 and 16 to first leg frame 13. Third leg frame 188 is pivotally connected to second leg frame 14 by pivot pins 190 and 191. Third leg frame 188 is pivotally connected to fourth leg frame 189 at pivot pins 192 and 193, respectively. Outer support links 186 and 187 are pivotally connected at their upper ends with back frame 12 and second leg frame 14 at the pivot pins (only one shown at 194).

Like first and second leg frames 13 and 14, third and fourth leg frames 188 and 189 each have left and right side rails that have axes. Assembled as shown in FIG. 15, the axes of the following pairs are substantially coplanar: left frame link 15 and outer support link 186; right frame link 16 and outer support 187; the corresponding left and right side rails of back frame 12, of first leg frame 13 and of third leg frame 188; and, the corresponding left and right side rails of second leg frame 14 and of fourth leg frame 189. The adaptation of folding chair 10 to folding 185 is further modified by removing the bottom cross rail 48 from first leg frame 13. The bottom cross rail 38 of second leg frame 14 is kept to provide a foot rest for the user.

Figure 17:
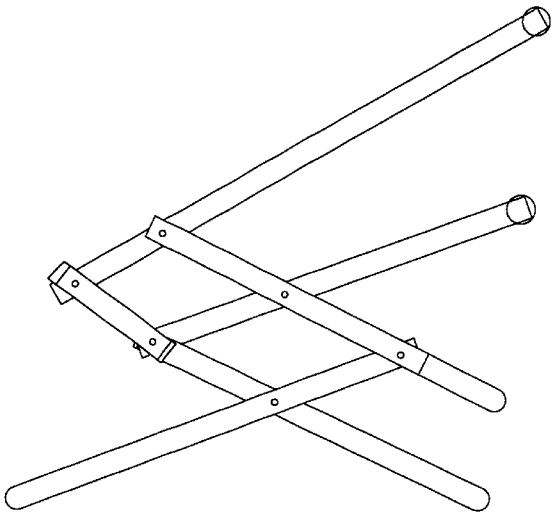
FIG. 17 is a side elevational view of the folding chair of FIG. 16, and shown folded further from the erected, rest condition toward the collapsed condition than from the chair of FIG. 16.
Figure 16:
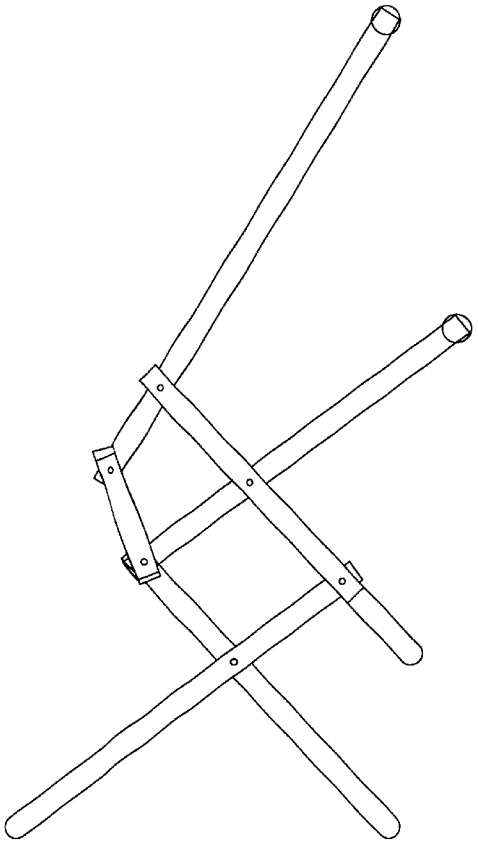
FIG. 16 is a side elevational view of the folding chair 185 of FIG. 15 and shown partially folded from the erected, rest condition of FIG. 15.
Figure 18:
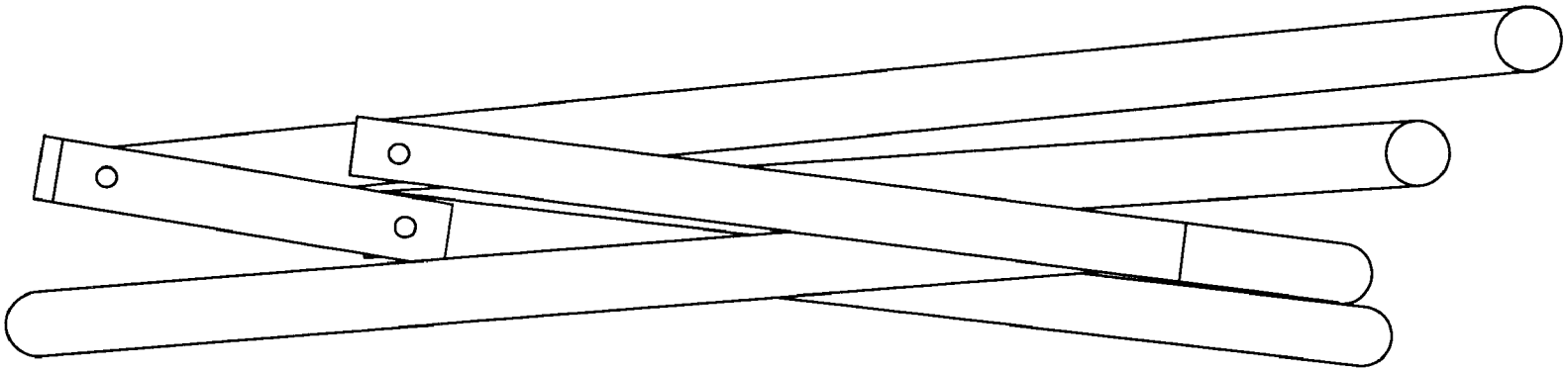
FIG. 18 is a side elevational view of the folding chair of FIG. 17 shown folded to the collapsed condition.

FIGS. 16–18 show folding chair 185 in successive stages as it is folded from its erected, rest condition of FIG. 15 to its collapsed condition shown in FIG. 18.

The outer support links 186 and 187 are parallel to the side rails 36 and 37 of second leg frame 14 and are joined to respective side rails 36 and 37 at two places: at the their upper ends (only one shown at 194) and at their lower ends at 190 and 191. As a consequence, outer support links 186 and 187 are substantially immovable relative to second leg frame 14, and outer support link 186 is considered to be an operational part of left side rail 36, and outer support link 187 is considered to be an operational part of right side rail 37. In the chair 10 of FIG. 1, the left and right frame links 15 and 16 are connected to the insides of the side rails of back frame 12 and first leg frame 13, while in the chair 185 of FIG. 15, the frame links 15 and 16 are connected to the outsides of such side rails. This is so that fourth frame leg 189 can be connected to the insides of the side rails of both first and third leg frames 13 and 188. The axes of left and right frame links 15 and 16 are coplanar with the axes of the corresponding outer support links 186 and 187, respectively, and are therefore still considered to be coplanar with the side rails of second leg frame 14.

Viewed another way, an alternative, but substantially identical embodiment contemplates the bottom cross rail 38 extending across the bottoms of outer support links 186 and 187 instead of across the bottoms of left and right side rails 36 and 37. Side rails 36 and 37 would then simply extend between their pivotal connections at upper pivot pins (one shown at 194) and lower pivot pins 190 and 191, just as support links 186 and 187 do in the chair of FIG. 15. The combination of links 186 and 187 and rails 36 and 37 act as a unit and have axes (in links 186 and 187) that are co-planar with the axes of links 15 and 16.

As used herein, leg frames, such as leg frames 132 and 133 of FIG. 14, are described as being U-shaped. It is contemplated that such "U-shaped" description includes other shapes, for example an H-shape, it being important that there be the described side rails to pivotally connect with other side rails and links so that the chair may fold as described and shown. The various cross members extending between the side rails are primarily for structural stability, and other configurations, such as an H-shape or X-shape or other structurally sound shapes, are contemplated within the meaning of "U-shape." While the invention has been described in detail in the foregoing description, the same is to be considered as illustrative and not restrictive in character, it being understood that only the preferred embodiments have been shown and described, and that all changes and modifications that come within the spirit of the invention are desired to be protected.

What is claimed is:

1. A chair, comprising:

first leg frame means having at least one left and one right side rail, each having upper and lower ends and corresponding left and right axes, said first leg frame means also including a front cross rail connected across the upper ends of at least two of the side rails;

second leg frame means having at least one left and one right side rail, each having upper and lower ends and corresponding left and right axes;

back frame means having at least one left and one right side rail, each having upper and lower ends and corresponding left and right axes, said back frame means also including a top cross rail connected across the upper ends of the back frame side rails;

frame link means having at least one left and at least one right frame link member, each having upper and lower ends and corresponding left and right axes;

a flexible support member extending between the top cross rail and the front cross rail;

wherein left and right side rails of said second leg frame means are pivotally connected along a first pivot axis to respective left and right side rails of said back frame means and are pivotally connected along a second pivot axis to respective left and right side rails of said first leg frame means;

wherein left and right frame link members of said frame link means are pivotally connected along a third pivot axis to respective left and right side rails of said back frame means and are pivotally connected along a fourth pivot axis to respective left and right side rails of said first leg frame means;

wherein said chair may be folded between an erected, rest condition and a collapsed condition; and, wherein at least one left axis of said first leg frame means and at least one left axis of said back frame means are substantially coplanar and at least one left axis of said second leg frame means and at least one left axis of said frame link means are substantially coplanar when the chair is in either the erected, rest condition or the collapsed condition.

2. The chair of claim 1 wherein at least one right axis of said first leg frame means and at least one right axis of said back frame means are substantially coplanar and at least one right axis of said second leg frame means and at least one right axis of said frame link means are substantially coplanar.

3. The chair of claim 2 wherein said first leg frame means includes at least two U-shaped leg frames each including one of the at least one left and one of the at least one right side rails, and wherein said second leg frame means includes at least two U-shaped leg frames each including one of the at least one left and one of the at least one right side rails.

4. The chair of claim 3 wherein said frame link means includes at least two left and two right frame link members, each having upper and lower ends and corresponding left and right axes, and wherein said back frame means includes a central back link for pivotal connection to a left side rail of one U-shaped leg frame of said second leg frame means and to a right side rail of another U-shaped leg frame of said second leg frame means.

5. The chair of claim 3 wherein said frame link means includes at least two U-shaped frame links each including one of the at least one left and one of the at least one right frame link members.

6. The chair of claim 3 wherein said frame link means includes at least two pairs of frame link members each including one of the at least one left and one of the at least one right frame link members, and wherein said back frame means includes a central back link for pivotal connection to a left side rail of one U-shaped leg frame of said second leg frame means and to a right side rail of another U-shaped leg frame of said second leg frame means and for pivotal connection to a left frame link member of one pair of frame link members and to a right frame link member of another pair of frame link members.

7. The chair of claim 1 wherein the erected, rest condition includes said first and second leg frames forming a first angle about the second pivot access of about 98 degrees, and the collapsed condition including said first angle being about 10 degrees.

8. The chair of claim 1 wherein the erected, rest condition includes the first pivot axis being above the second pivot axis and the fourth pivot axis being below the third pivot axis.

9. The chair of claim 8 wherein the collapsed condition includes the second pivot axis being above the first pivot axis and the fourth pivot axis being above the third pivot axis.

10. The chair of claim 1 wherein said at least one left and right frame link members each define a stop surface at its upper end, and wherein said chair further includes an erected, stressed condition wherein the stop surfaces of said left and right frame link members are engaged with the left and right side rails, respectively, of said second leg frame means, thereby precluding rotation of said second leg frame means in one direction about said second pivot axis relative to said first leg frame means.

11. The chair of claim 10 wherein the stop surfaces of said frame link members comprise a pair of resilient end caps connected to the uppermost ends of the left and right frame link members.

12. The chair of claim 1 wherein said at least one left and right side rails of said back frame means each define lower stop surfaces located below the third pivot axis, and wherein said chair further includes an erected, stressed condition wherein the lower stop surfaces are engaged with the left and right side rails of said first leg frame means, thereby precluding rotation of said first leg frame means in one direction about said second pivot axis relative to said second leg frame means.

13. The chair of claim 12 wherein the stop surfaces of said back frame means comprise a pair of resilient end caps connected to the lowermost ends of the left and right side rails of said first leg frame means.

14. The chair of claim 1 further including a cross bar connected to and extending between two side rails of said back frame means, and wherein said flexible support extends from the top cross rail, below the cross bar, and to the front cross rail.

15. The chair of claim 14 wherein said flexible support is a band of fabric.

16. The chair of claim 14 wherein said flexible support is a band of material having opposing looped ends which surround and are thus supported by the front and top cross rails, respectively.

17. The chair of claim 1 wherein said second leg frame includes at least one cross rail extending between a left and right side rail of said second leg frame means.

18. The chair of claim 1 further including third and fourth leg frames each having left and right side rails.

19. The chair of claim 18 wherein said third leg frame is pivotally connected along a fifth pivot axis to said second leg frame.

20. The chair of claim 19 wherein said fourth leg frame is pivotally connected along the fourth pivot axis to said first leg frame and to respective left and right frame links.

21. The chair of claim 20 wherein said third leg frame is pivotally connected along a sixth pivot axis to said fourth leg frame.

22. The chair of claim 1 further including third, fourth, fifth and sixth leg frames each having left and right side rails.

23. The chair of claim 22 wherein said third leg frame is pivotally connected along a fifth pivot axis to said second leg frame and wherein said fourth leg frame is pivotally connected along the fourth pivot axis to said first leg frame and to respective left and right frame links and wherein said third leg frame is pivotally connected along a sixth pivot axis to said fourth leg frame and wherein said fifth leg frame is pivotally connected along a seventh pivot axis to said third leg frame and along an eight pivot axis to said sixth leg frame and said sixth leg frame is pivotally connected along a ninth pivot axis to said fourth leg frame.

24. A folding chair, comprising:

first leg frame means having a plurality of first side rails, each having upper and lower ends and mutually parallel axes, and further including a front cross rail connected to the upper ends of two of the first side rails;

second leg frame means having a plurality of second side rails, each having upper and lower ends and mutually parallel axes;

back frame means having a plurality of back side rails, each having upper and lower ends and mutually parallel axes, and further including at least one top cross rail connected to the upper ends of two of the back side rails;

frame link means having a plurality of frame link members, each having upper and lower ends and mutually parallel axes;

a flexible support member extending between the top cross rail and the front cross rail;

wherein at least one second side rail is pivotally connected along a first pivot axis to at least one back side rail and is pivotally connected along a second pivot axis to at least one first side rail;

wherein at least one frame link member is pivotally connected along a third pivot axis to at least one back side rail and is pivotally connected along a fourth pivot axis to at least one first side rail; and, wherein at least one axis of a first first side rail and at least one axis of a back side rail are substantially coplanar and at least one axis of a second side rail and at least one axis of a frame link are substantially coplanar when the chair is in either the erected, rest condition or the collapsed condition.

25. A folding chair, comprising:

first leg frame means having a plurality of first side rails, each having upper and lower ends and mutually parallel axes, and further including a front cross rail connected to the upper ends of two of the first side rails;

second leg frame means having a plurality of second side rails, each having upper and lower ends and mutually parallel axes;

back frame means having a plurality of back side rails, each having upper and lower ends and mutually parallel axes, and further including at least one top cross rail connected to the upper ends of two of the back side rails;

frame link means having a plurality of frame link members, each having upper and lower ends and mutually parallel axes;

a flexible support member extending between the top cross rail and the front cross rail;

a central back link having an upper and lower end and having an axis lying in a plane with the back side rails;

wherein at least one second side rail is pivotally connected along a first pivot axis to at least one back side rail and is pivotally connected along a second pivot axis to at least one first side rail;

wherein at least one frame link member is pivotally connected along a third pivot axis to at least one back side rail and is pivotally connected along a fourth pivot axis to at least one first side rail; and, wherein said central back link is pivotally connected along the first pivot axis to at least one second side rail and is pivotally connected along the third pivot axis to at least one frame link member.

26. The folding chair of claim 25 wherein there are at least four of the second side rails and at least four of the frame link members.

27. The folding chair of claim 25 wherein said first leg frame means includes a pair of U-shaped leg frames each having a pair of opposing first side rails.

28. The folding chair of claim 25 wherein said second leg frame means includes a pair of U-shaped leg frames each having a pair of opposing second side rails.

29. The folding chair of claim 25 wherein said frame link means includes a pair of U-shaped leg frames each having a pair of opposing frame link members.

30. The folding chair of claim 25 wherein said chair may be folded between an erected, rest condition and a collapsed condition, the erected rest condition including the first pivot axis being above the second, third and fourth pivot axes and the fourth pivot axis being below the first, second and third pivot axes.

31. The folding chair of claim 30 wherein the collapsed condition includes the second pivot axis being above the first, third and fourth pivot axes and the third pivot axis being below the first, second and fourth pivot axes.

32. The folding chair of claim 30 wherein said back side rails each define a lower stop surface located below the third pivot axis, and wherein said chair further includes an erected, stressed condition wherein the lower stop surfaces are engaged with the first side rails, thereby precluding rotation of said first leg frame means in one direction about said second pivot axis relative to said second leg frame means.

33. The chair of claim 32 wherein the stop surfaces of said back frame means comprise a pair of resilient end caps connected to the lower ends of said first side rails.

34. The chair of claim 30 wherein said frame link members each define a stop surface at its upper end, and wherein said chair further includes an erected, stressed condition wherein the stop surfaces of said frame link members are engaged with the second side rails, thereby precluding rotation of said second leg frame means in one direction about said second pivot axis relative to said first leg frame means.

35. The chair of claim 34 wherein the stop surfaces of said frame link members comprise a pair of resilient end caps connected to the uppermost ends of the frame link members.

36. The chair of claim 25 further including a cross bar connected to and extending between two back side rails, and wherein said flexible support extends from the top cross rail, below the cross bar, and to the front cross rail.

37. The chair of claim 36 wherein said flexible support is a band of fabric.

38. A chair, comprising:

a first leg frame having first side rails with upper ends and a front cross rail connected to the upper ends;

a second leg frame having second side rails;

a back frame having back side rails with upper ends and a top cross rail connected to the upper ends of the back side rails;

a frame link assembly having a plurality of frame link members;

a flexible support member extending between the top cross rail and the front cross rail;

a central back link; and, wherein one of the second side rails is pivotally connected along a first axis to one of the back side rails and is pivotally connected along a second axis to one of the first side rails, wherein a frame link member is pivotally connected along a third pivot axis to one of the back side rails and is pivotally connected along a fourth pivot axis to one of the first side rails, and wherein said central back link is pivotally connected along the first pivot axis to one of the second side rails and is pivotally connected along the third pivot axis to one of the frame link members.

* * * * *